US005160945A

United States Patent [19]

Drake

[11] Patent Number: 5,160,945

[45] Date of Patent: Nov. 3, 1992

[54] PAGEWIDTH THERMAL INK JET PRINTHEAD

[75] Inventor: Donald J. Drake, Rochester, N.Y.

[73] Assignee: Xerox Corporation, Stamford, Conn.

[21] Appl. No.: 698,206

[22] Filed: May 10, 1991

[51] Int. Cl.[5] ..... B41J 2/05; B41J 2/155

[52] U.S. Cl. ..... 346/140 R

[58] Field of Search ..... 346/140 R

[56] References Cited

U.S. PATENT DOCUMENTS

| | | | |
|---|---|---|---|
| Re. 32,572 | 1/1988 | Hawkins et al. | 156/626 |
| 4,568,953 | 2/1986 | Aoki et al. | 346/140 R |
| 4,789,425 | 12/1988 | Drake et al. | 156/644 |
| 4,829,324 | 5/1989 | Drake et al. | 346/140 R |
| 4,851,371 | 7/1989 | Fisher et al. | 437/226 |
| 4,935,750 | 6/1990 | Hawkins | 346/140 R |
| 4,985,710 | 1/1991 | Drake et al. | 346/1.1 |
| 5,016,023 | 5/1991 | Chan | 346/140 R |
| 5,057,854 | 10/1991 | Pond | 346/140 R |

*Primary Examiner*—Joseph W. Hartary
*Attorney, Agent, or Firm*—Robert A. Chittum

[57] ABSTRACT

A pagewidth thermal ink jet printhead for an ink jet printer is disclosed. The printhead is the type assembled from fully functional roofshooter type printhead subunits fixedly mounted on the surface of one side of a structural bar. A passageway is formed adjacent the bar side surface containing the printhead subunits with openings provided between the passageway and the ink inlets of the printhead subunits, mounted thereon so that ink supplied to the passageway in the bar will maintain the individual subunits full of ink. The size of the printing zone for color printing is minimized because the roofshooter printhead subunits are mounted on one edge of the structural bar and may be stacked one on top of the other without need to provide space for the printhead subunits and/or ink supply lines. In addition, the structural bar thickness enables the bar to be massive enough to prevent warping because of printhead operating temperatures.

8 Claims, 8 Drawing Sheets

PAGEWIDTH THERMAL INK JET PRINTHEAD

BACKGROUND OF THE INVENTION

This invention relates to thermal ink jet printing on demand, and more particularly to pagewidth thermal ink jet printheads of the type assembled from fully functional roofshooter type printhead subunits.

There are two general configurations for thermal, drop-on-demand, ink jet printheads. In one configuration, droplets are propelled from nozzles in a direction parallel to the flow of ink in ink channels and parallel to the surface of the bubble-generating heating elements of the printhead, such as, for example, the printhead configuration disclosed in U.S. Pat. No. Re. 32,572 to Hawkins et al. and schematically shown in FIG. 1. This configuration is sometimes referred to as edge or side shooters. The other thermal ink jet configuration propels droplets from nozzles in a direction normal to the surface of the bubble-generating heating elements such as, for example, the printhead disclosed in U.S. Pat. No. 4,568,953 to Aoki et al. This latter configuration is sometimes referred as a roofshooter and is schematically illustrated in FIG. 2. It can be seen that a fundamental difference lies in the direction of droplet ejection. The sideshooter configuration ejects droplets in the plane of the substrate having the heating elements, while the roofshooter ejects droplets out of the plane of the substrate having the heating elements and in a direction normal thereto.

U.S. Pat. No. Re. 32,572 to Hawkins et al. discloses a sideshooter configuration for a thermal ink jet printhead and several fabricating processes therefor. Each printhead is composed of two parts aligned and bonded together. One part is a substantially flat substrate which contains on the surface thereof a linear array of heating elements and addressing electrodes, and the second part is a substrate having at least one recess anisotropically etched therein to serve as an ink supply manifold when the two parts are bonded together. A linear array of parallel grooves are also formed in the second part so that one end of the grooves communicate with the manifold recess and the other ends are open for use as ink droplet expelling nozzles. Many printheads can be made simultaneously by producing a plurality of sets of heating element arrays with their addressing electrodes on a silicon wafer. A corresponding plurality of sets of channels and associated manifolds are produced in a second silicon wafer. The two wafers are aligned and bonded together and then diced into many separate printheads. The printheads may be used in carriage-type printers for printing swaths of information and then stepping the recording medium a distance of one swath and continuing to print adjacent swaths of information until a full page of information is printed. Alternatively, the printheads may be considered as subunits of a pagewidth printhead and arranged on a structural image bar for pagewidth printing. In pagewidth printing, the printheads may be assembled by abutting a plurality of the printhead subunits end-to-end on the image bar or staggering them on two separate image bars or on opposite sides of the same image bar.

U.S. Pat. No. 4,568,953 to Aoki et al. discloses a thermal ink jet printhead in which the droplets are ejected on demand through nozzles aligned above and parallel to the heating elements, so that the droplet trajectories are normal to the heating elements. In order to prevent nozzle clogging, the ink is circulated through the printhead and internal passageways having cross-sectional flow areas larger than the nozzles. This enables particulate matter larger than the nozzles to pass and be swept away by the circulating ink entering and leaving the printhead through inlet and outlet tubes.

U.S. Pat. No. 4,789,425 to Drake et al. discloses a roofshooter-type thermal ink jet printhead, wherein each printhead comprises a silicon heater plate and a fluid directing structural member. The heater plate has a linear array of heating elements, associated addressing electrodes, and an elongated ink-filled hole parallel with the heating element array. The structural member contains at least one recessed cavity, a plurality of nozzles, and a plurality of parallel walls within the recessed cavity which define individual ink channels for directing the ink to the nozzles. The recessed cavity and fill hole are in communication with each other and form the ink reservoir within the printhead. The ink holding capacity of the fill hole is larger than that of the recessed cavity. The fill hole is precisely formed and positioned within the heater plate by anisotropic etching. The structural member may be fabricated either from two layers of photoresist, a two-stage flat nickel electroform, or a single photoresist layer and a single stage flat nickel electroform.

U.S. Pat. No. 4,829,324 to Drake et al. discloses a large array ink jet printhead having two basic parts, one containing an array of heating elements and addressing electrodes on the surface thereof, and the other containing the liquid ink handling system. At least the part containing the ink handling system is silicon and is assembled from generally identical subunits aligned and bonded side-by-side on the part surface having the heating element array. In one embodiment a plurality of channel plate subunits are anisotropically etched in a silicon wafer and a plurality of heating element subunits are formed on another silicon wafer. The heating element wafer is also anisotropically etched with elongated slots. The wafers are aligned and bonded together, then diced into complete printhead subunits which have abutting side surfaces that are {111} planes for accurate side-by-side assembly.

U.S. Pat. No. 4,851,371 to Fisher et al. and U.S. Pat. No. 4,935,750 to Hawkins disclose a cost effective method of fabricating a large array or pagewidth silicon device having high resolution. The pagewidth device is assembled by abutting silicon device subunits such as image sensors or thermal ink jet printheads. For printheads, the subunits are fully functional small printheads comprising an ink flow directing channel plate and a heating element plate which are bonded together. A plurality of individual printhead subunits are obtained by dicing aligned and bonded channel wafers and heating element wafers. The abutting edges of the printhead subunits are diced in such a manner that the resulting kerfs have vertical to inwardly directed sides which enable high tolerance linear abutment of adjacent subunits. U.S. Pat. No. 4,935,750 discloses how a pagewidth printhead may be further stabilized and strengthened by assembly of printhead subunits on a flat structural member. Assembly of the pagewidth printhead is complete when an elongated hollow conduit means having a plurality of outlets is mounted over the subunits with each outlet aligned with a one of the inlets of the printhead subunits. Gaskets are sealed to the outlets of the conduit means by, for example, an adhesive earlier screened onto the gasket. The gasket sealingly surrounds the printhead subunit inlet and outlets of the conduit means and prevents the ink supplied to the printhead subunits via the conduit means from leaking at the interface therebetween.

U.S. Pat. No. 4,985,710 to Drake et al. discloses a "roofshooter" pagewidth printhead for use in a thermal ink jet printing device fabricated from a plurality of subunits, each being produced by bonding a heater substrate, having an architecture including an array of heater elements and an etched ink feed slot, to a secondary substrate having a series of spaced feed hole openings to form a combined substrate in which the series of spaced feed hole openings communicates with the ink feed slot, and dicing the combined substrates through the ink feed slot to form a subunit. An array of butted subunits having a length equal to one pagewidth is formed by butting one of the subunits against an adjacent subunit. The array of butted subunits is bonded to a pagewidth support substrate. The secondary substrate provides an integral support structure for maintaining the alignment of the heater plate which, if diced through the feed hole without the secondary substrate, would separate into individual pieces, thereby complicating the alignment and assembly process.

SUMMARY OF THE INVENTION

It is the object of the present invention to provide a pagewidth thermal ink jet printhead assembled from roofshooter-type printhead subunits.

It is another object of the invention to provide a pagewidth printhead having a minimum dimension in the direction of the movement of the recording medium thereby.

It is still another object of the invention to provide a pagewidth printhead having a larger dimension in the direction perpendicular to both the recording medium and printhead in order to confer stiffness and wrap resistance to the printhead.

It is yet another object of the invention to provide a pagewidth print bar which internally incorporates the ink distribution system, thereby eliminating additional ink distribution components and resulting in the ability to more closely space pagewidth printheads for multicolor printing.

It is a further object of the invention to provide a plurality of pagewidth printheads for multi-color printing which minimizes the printing zone area.

In the present invention, a pagewidth thermal ink jet printhead for an ink jet printer is assembled from fully functional roofshooter-type printhead subunits which are fixedly mounted on the surface of one side of a structural bar. A passageway is formed in the bar and adjacent the bar side surface containing the printhead subunits with openings provided between the passageway and the ink inlets of the printhead subunits mounted thereon, so that ink supplied to the passageway in the bar will maintain the individual subunits full of ink. The size of the printing zone for color printing, wherein a plurality of pagewidth printheads are used, is minimized because the roofshooter printhead subunits are mounted on one edge of the structural bar and may be stacked one on top of the other without need to provide space for the printhead subunits and/or ink supply manifolds or lines. In addition, the structural bar thickness enables the bar to be massive enough to prevent warping because of printhead operating temperatures.

The foregoing features and other objects will become apparent from a reading of the following specification in conjunction with the drawings, wherein like parts have the same index numerals.

While the present invention will be described hereinafter in connection with preferred embodiments thereof, it is not intended to limit the invention to those embodiments. On the contrary, it is intended to cover all alternatives, modifications, and equivalents as may be included in the spirit and scope of the invention as defined by the appended claims.

DESCRIPTION OF THE PREFERRED EMBODIMENT

Figure 1:
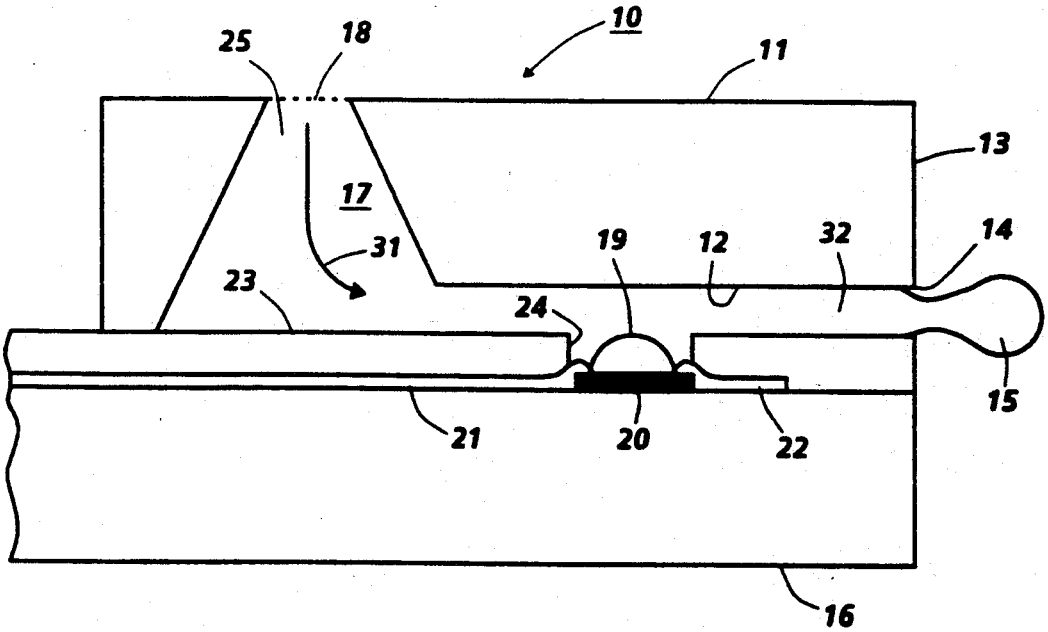
FIG. 1 (Prior Art)
FIG. 1 is a schematic cross-sectional view of a typical sideshooter-type thermal ink jet printhead.

In FIG. 1, a typical sideshooter or edgeshooter-type thermal ink jet printhead 10 is schematically shown in cross-sectional view with the capillary-filled channel 12 terminating with a nozzle 14 at the edge or side 13 of the printhead. The other end of the channel communicates with reservoir 17 which is anisotropically etched in silicon channel plate 11. Concurrently etched with the reservoir, or in a separate etching step, the channels 12 are etched in channel plate 11, as disclosed in U.S. Pat. No. Re. 32,572 to Hawkins et al. and U.S. Pat. No. 4,935,750 to Hawkins. Heater plate 16 contains the heating elements 20 and passivated addressing electrodes 21 and common return 22 (passivation layer not shown) over which thick film layer 23 is laminated and patterned to provide individual recesses over each heating element to form pits 24. The reservoirs 17 are formed by through etches which provide inlet 25 for entrance of the ink 32 through filter 18 which is placed over the inlet. As is well known in the art, electric pulses applied to the heating element momentarily vaporizes the ink and forms bubble 19 which expels droplet 15 from nozzle 14. The ink in the channels are supplied by capillary action from reservoir 17 as shown by arrow 31.

Figure 2:
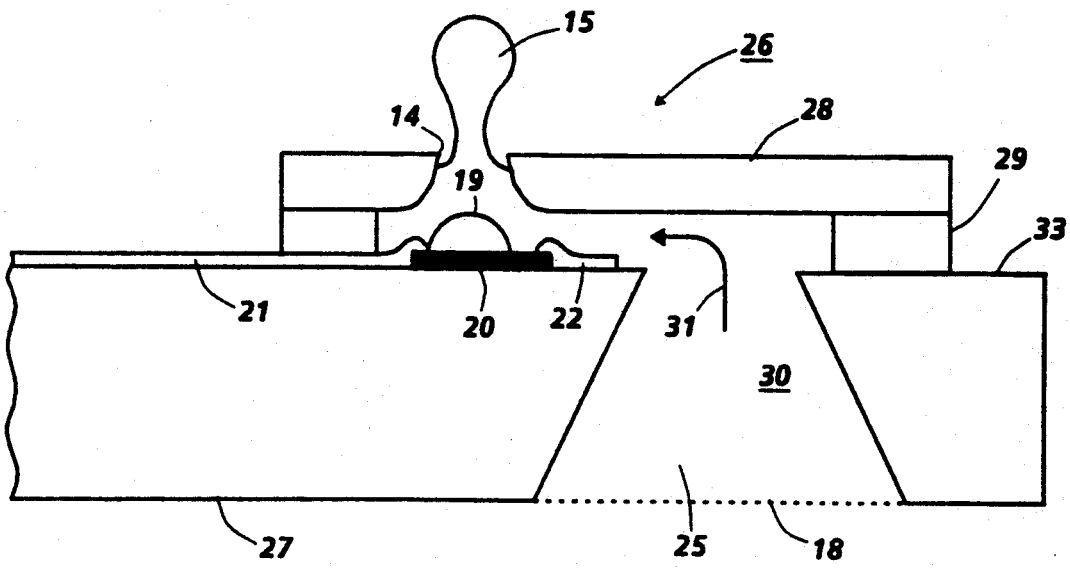
FIG. 2 (Prior Art)
FIG. 2 is a schematic cross-sectional view of a typical roofshooter-type thermal ink jet printhead.

A typical roofshooter-type thermal ink jet printhead is shown in FIG. 2. In this configuration, the silicon heater plate 27 has a reservoir or feed slot 30 etched therethrough. The inlet 25 is covered by filter 18. An array of heating elements 20 are patterned on heater plate surface 33 near the open bottom of reservoir 30. The heating elements are selectively addressed via passivated addressing electrodes 21 and common return 22 (passivated layer not shown). A flow directing layer 29 is patterned to form flow paths for the ink from the reservoir to a location above the heating elements as shown by arrow 31. A nozzle plate 28 containing nozzles 14 is aligned and bonded to flow directing layer 29 so that the nozzles are directly above the heating elements. Electric signals applied to the heating element temporarily vaporizes the ink and forms droplet ejecting bubbles 19 which eject droplet 15 in a direction normal to the heating element.

Figure 3A:
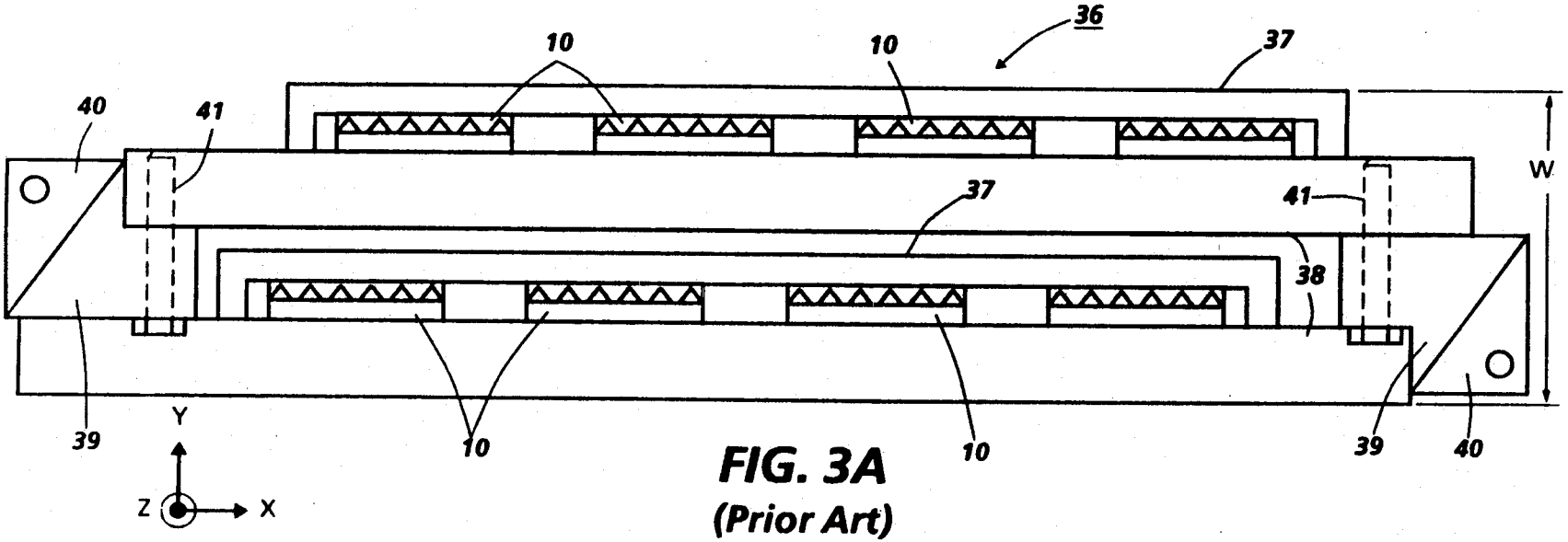
FIG. 3A (Prior Art)
FIG. 3A is a front view of a typical pagewidth printhead formed by staggered sideshooter printhead subunits on two separate structural bars.
Figure 3B:
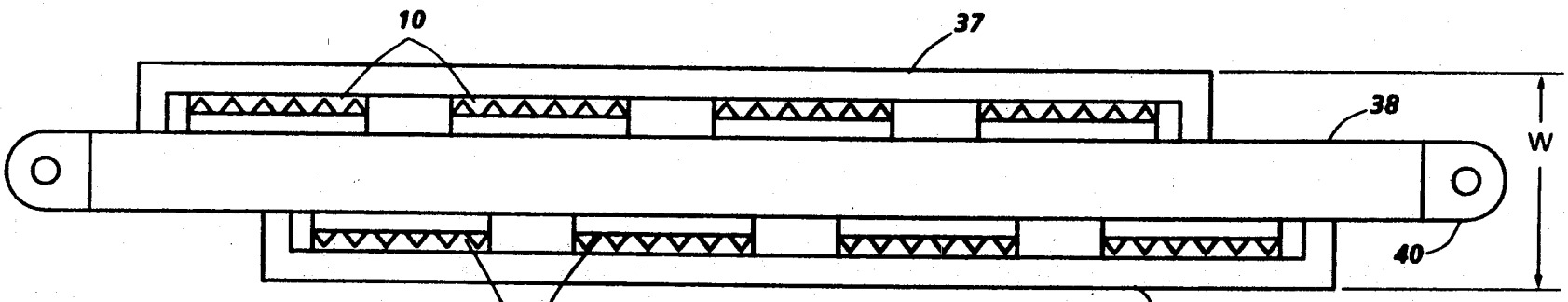
FIG. 3B (Prior Art)
FIG. 3B is a front view of a typical pagewidth printhead formed by sideshooter printhead subunits in a staggered array on opposite sides of a single structural bar.

FIG. 3A depicts one prior art embodiment of a pagewidth thermal ink jet printhead wherein the fully functional sideshooter printhead subunits are mounted on structural bars 38 in an equally spaced manner. The structural bars with sideshooter printheads 10 similar to those shown in FIG. 1 are fastened together by bar connectors 39 having mounting flanges 40. The printheads on each structural bar are supplied with ink from manifold 37 which has openings (not shown) aligned and sealed with the inlets of the printhead subunits. The bar connectors provide the appropriate spacing between bars to provide clearance for the ink manifolds as well as the printhead subunits. The structural bars and connectors are fixedly attached to each other by, for example, bolts 41. The printhead subunits on one of the structural bars are offset from the printhead subunits of the other structural bar to provide pagewidth coverage by the droplets ejected from the nozzles from all of the printhead subunits. To aid in the understanding of the orientation of the pagewidth printhead, the X, Y and Z coordinates are shown in FIG. 3A, with the Z direction being the direction the droplets travel from the printhead nozzles to the recording medium. The X direction is in a plane parallel to the recording medium, and the Y direction indicates the direction of movement of the recording medium past the pagewidth printhead. Thus, in this view, the droplets would travel from the nozzles at the plane of the paper in a direction perpendicular therefrom towards the viewer. An alternate prior art pagewidth printhead utilizing sideshooter printhead subunits is shown in FIG. 3B, where a single structural bar 38 is used with mounting bar flanges 40 on either edge and with the sideshooter thermal ink jet printhead subunits mounted in a staggered fashion on opposite sides thereof. The printhead subunits on each side of the bar has an ink manifold 37 with openings (not shown) aligned and sealed with the inlets of the printhead subunits to prevent ink leakage therefrom.

Figure 4:
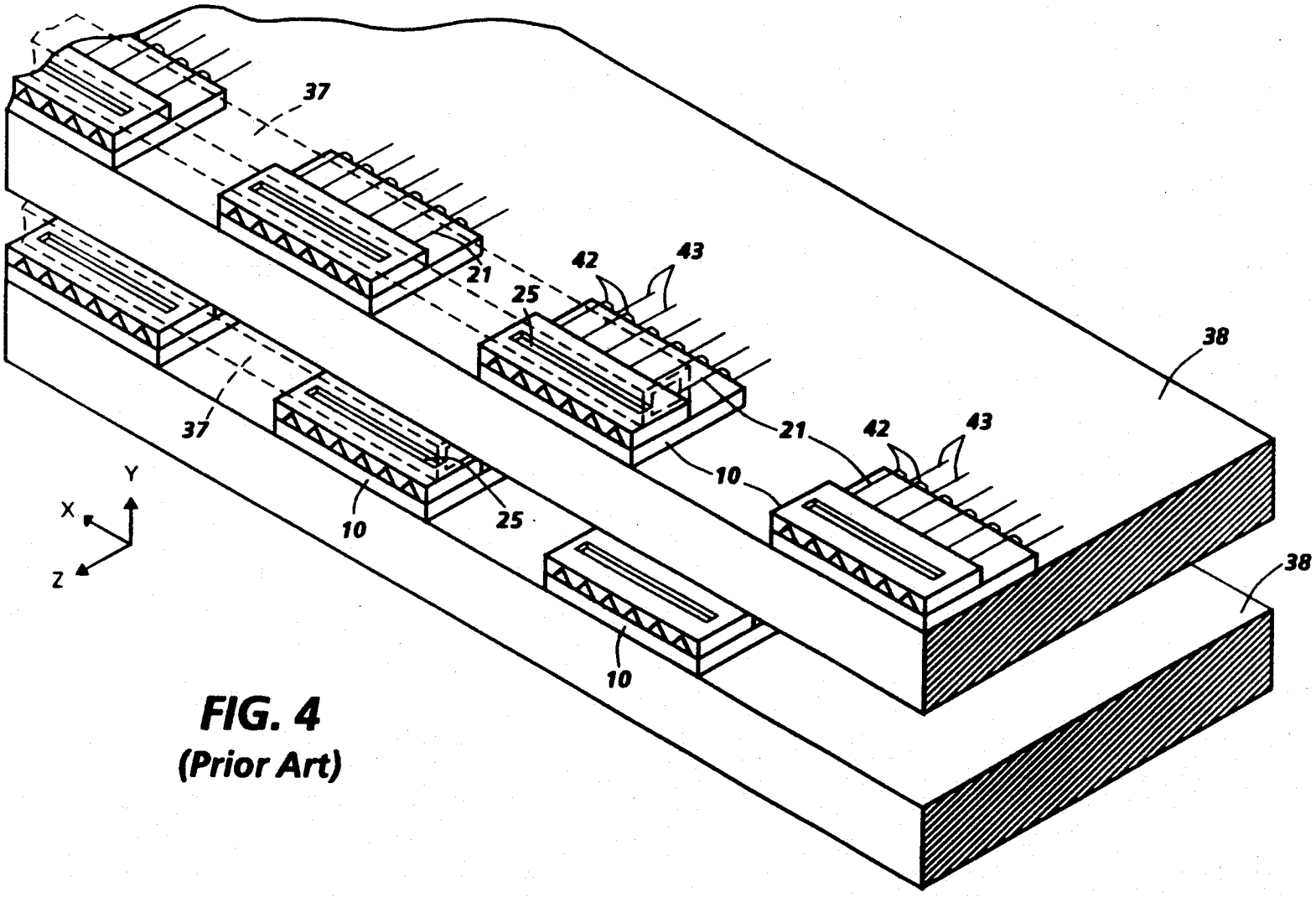
FIG. 4 (Prior Art)
FIG. 4 is a partial isometric view of the pagewidth printhead shown in FIG. 3A.

Referring to FIG. 4, a portion of the pagewidth printhead of FIG. 3A is shown in isometric view with the ink supplying manifolds 37 partially shown in dashed line. The X, Y and Z coordinates show the orientation of the printhead subunits 10 relative to the recording medium (not shown). In this figure, each of the subunits are shown with the signal supplying lines 43 attached to the printhead electrodes 21 via wire bonds 42.

Figure 5:
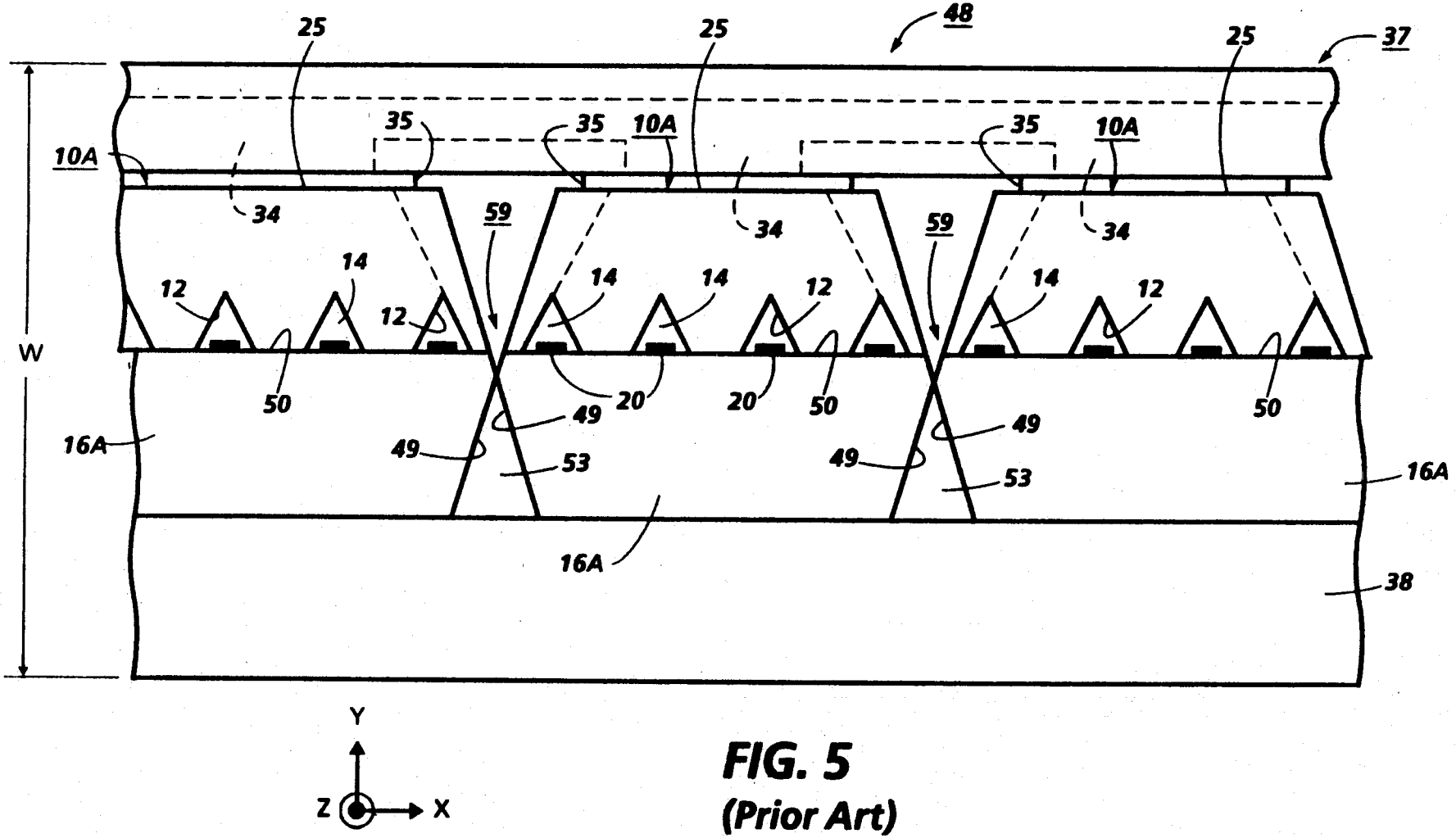
FIG. 5 (Prior Art)
FIG. 5 is an enlarged partially shown front view of a typical pagewidth printhead formed from the abutment of smaller sideshooter printhead subunits produced by the abutment of the subunits on a single structural bar.

An alternate embodiment of a prior art pagewidth printhead is shown in FIG. 5. In this configuration, an enlarged partially shown front elevation view of a pagewidth ink jet printhead 48 is shown of the type that is assembled from sideshooter printhead subunits 10A abutted end-to-end. The length is the width of a page or about 8.5 inches (21.6 cm) to 11 inches (28 cm) and the front face height W of the printhead and ink supplying manifold is about 0.50 to 1.0 inch or 1.25 to 2.5 cm. Schematically illustrated heating elements 20 are shown in each channel 12 through nozzles 14. In this pagewidth embodiment, a very small v-groove 59 is optionally anisotropically etched in the surface of the heater plate wafer parallel to and on opposing sides of each set of heating elements, so that the slightly slanted dicing used to produce slanted walls 49 do not cut through the surface 50 containing the heating elements and supporting electrodes and circuitry (not shown). This eliminates all micro-cracking because the dicing blade only cuts outside of the {111} plane of the small v-groove 59. The confronting walls 49 of the heater plate 16A were preferably done with a slightly slanted dicing blade to enable the close tolerance abutting of the printhead subunits 10A. The oppositely sloping walls 49 produce gaps 53 because the bottom surface of the heater plates 16A are smaller than the top surfaces 50 when the dicing cut is made by slanted dicing blades which are slanted in equal but opposite directions. To strengthen the pagewidth printhead 48, the gaps 53 between the heater plates 16A specifically generated by slanted kerfs that produce sloping or slanted walls 49 may be optionally filled (not shown) with a flowable epoxy or other suitable adhesive. The pagewidth printhead 48 may be further stabilized and strengthened by assembly of the printhead subunits 10A on a flat structural member 38. Assembly of the pagewidth printhead 48 is complete when an elongated hollow manifold 37 having outlets 34, each aligned with inlets 25 of the printhead subunits 10A. Gaskets 35 are sealed to the manifold 37 by a suitable adhesive. The gasket sealingly surrounds the printhead subunit inlets and outlets of the manifold and prevents the ink supplied to the printhead subunits via the manifold from leaking at the interface therebetween. For a more detailed description of this prior art pagewidth printhead, refer to U.S. Pat. No. 4,935,750 to Hawkins. The X, Y, Z coordinates are also shown for this figure; thus, the droplets are ejected from the plane of the sheet containing FIG. 5 and in a direction normal thereto and in a direction towards the viewer.

Figure 6:
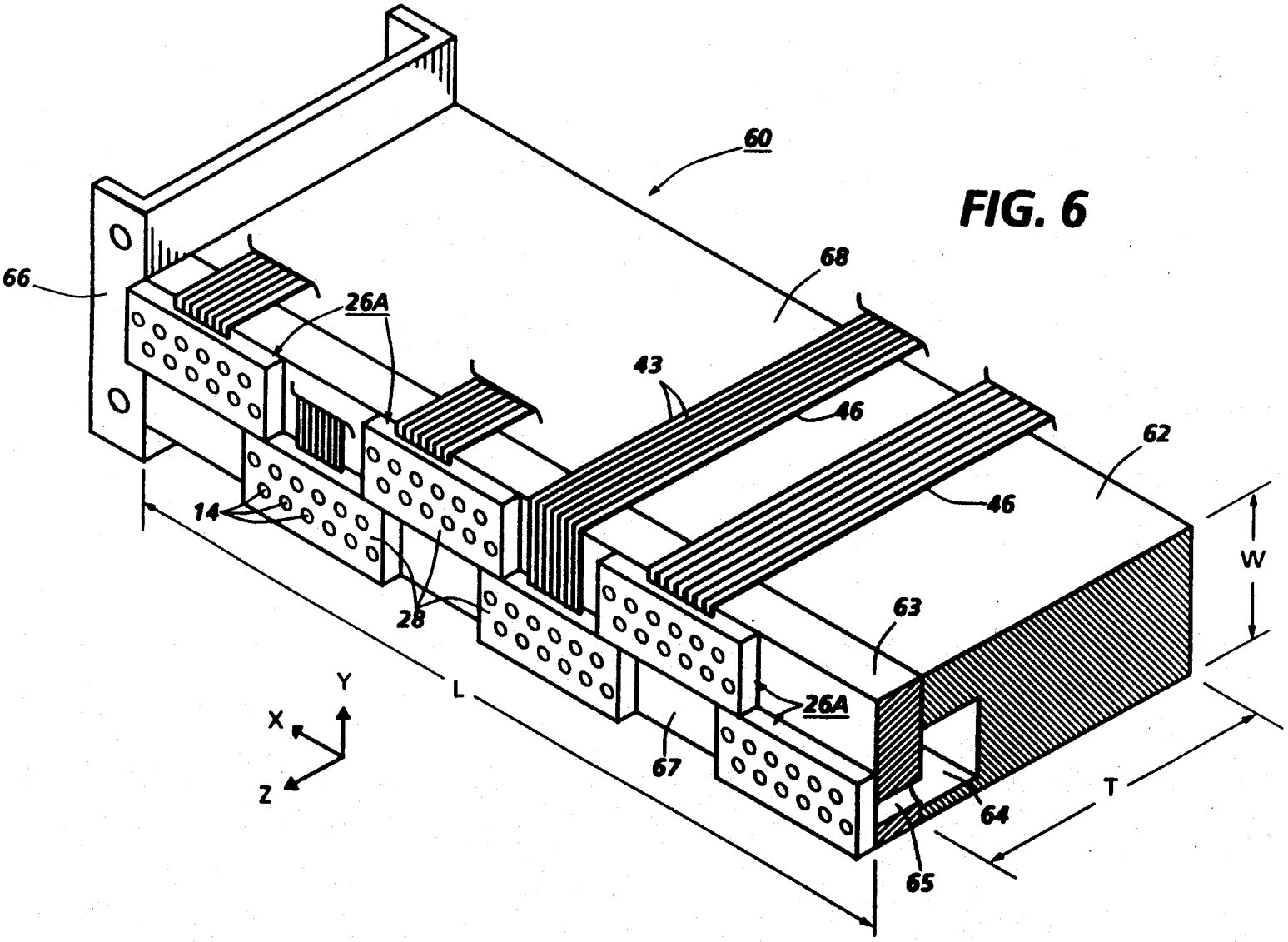
FIG. 6 is a partially shown isometric view of the pagewidth printhead of the present invention formed by staggered roofshooter printhead subunits on a single structural bar.

Referring to FIG. 6, a pagewidth thermal ink jet printhead 60 of the present invention is shown, using a roofshooter-type printhead subunits 26A. The printhead subunits, similar in construction to that depicted in FIG. 2, are mounted on edge 67 of structural bar 62 in two rows in an offset staggered manner. Each printhead subunit inlet is aligned with openings 65 in bar 62 which place the printhead subunit reservoirs 30 (see FIG. 2) into communication with ink supply passageway 64 formed in the bar adjacent the bar edge 67. Flexible cables 46 with signal lines 43 therein are mounted on surface 68 of the structural bar 62 and connected to electrodes 21 (FIG. 2) of the printhead subunits by means such as wire bonding (not shown). Mounting flanges 66 are attached to each end of the structural bar to provide means for mounting the pagewidth printhead in a printer. Each printhead subunit 26A contains two rows of nozzles offset from one another and a cross-sectional view through one nozzle is depicted in FIG. 2. For ease in providing a passageway for the ink, the structural bar comprises two parts, the main part has a groove 64 milled through one edge thereof and the other part is cover 63 which is bonded over the groove and which contains openings 65 therethrough. The length of the pagewidth bar is depicted by dimension L which is at least the distance across the width of the recording medium to be printed in the printer printing zone. The width of the structural bar is dimensioned to accommodate two printhead subunits and is depicted by the dimension W. A thickness or depth of the bar is shown as dimension T. An external ink supply (not shown) is located in a spaced location from the pagewidth printhead and provides ink to the passageway 64 in the structural bar by hoses (not shown). Ends of the hose are sealingly attached to the passageway 64 by well known coupling means.

There are two fundamental printhead architectures for thermal ink jet printheads. One is the edgeshooter or sideshooter printhead shown in FIG. 1. The other is the roofshooter printhead shown in FIG. 2. It can be seen that a fundamental difference lies in the direction of drop ejection. In the sideshooter configuration, droplets are ejected in a plane parallel to the heating element surfaces on the heater plate while in the roofshooter configuration, the droplets are ejected in a direction normal to the surface of the heating element.

In the construction of a pagewidth array of thermal ink jet printhead subunits to make a pagewidth thermal ink jet print bar, there are significant differences in the print bar architectures, depending upon which printhead subunit architecture is used. FIGS. 3A and 3B show a staggered subunit pagewidth print bar using sideshooter printheads, while FIG. 6 shows a staggered subunit pagewidth print bar using roofshooter printheads. The pagewidth printhead of FIGS. 3A and 3B uses the staggered offset configuration of sideshooter printhead subunit, while the pagewidth printhead of FIG. 5 uses pagewidth printhead subunits in an end-to-end abutment arrangement.

The pagewidth print bar of the present invention uses alternating staggered roofshooter printhead subunits in which each subunit has two arrays of staggered nozzles, one on each side of the ink reservoir or feed slot in the heater plate, although a single row of nozzles could be used as shown in FIG. 2 and disclosed in U.S. Pat. No. 4,789,425 to Drake et al. incorporated herein by reference. The use of two staggered rows of roofshooter printhead subunits avoids the technical issues associated with abutting collinear subunits as shown in FIG. 5, while preserving the adjacent nozzle distance across the pagewidth printhead. However, the array of subunits can also consist of a single row of abutted subunits, such as those described in U.S. Pat. No. 4,985,710 to Drake et al. incorporated herein by reference. While technically more difficult because of the required precision dicing, such a collinear array has the advantage of consuming less space in the Y or paper path direction. As discussed above with reference to FIG. 2, the roofshooter printhead subunits are fed with ink via a reservoir or slot in the print bar mounting substrate. The seal between the heater plate of the subunit and the substrate can simply be a printhead bonding adhesive normally used to attach printhead subunits to a substrate. This seal has no precision tolerances and uses commercial techniques and materials.

In the process of precision placement of the printhead subunits, there is a significant difference in the roofshooter and sideshooter pagewidth print bar architectures. Close tolerances are critical in the X and Y axis for spot placement. The X and Y axis are in the plane of the printhead for roofshooters as seen in FIG. 6, while, for the sideshooter, the X and Z axis are in the plane of the printhead but the Y axis is out of the plane of the printhead. The importance of this is twofold. First, roofshooter printheads can be aligned without the significant issues of silicon chip thickness variation or warpage of the structural substrate bar on which they are attached. These two dimensional variations effect the Z axis dimension which is much less critical for spot placement. For the sideshooter configuration, these two issues significantly effect the critical Y axis dimension, introducing adjacent pixel spot placement errors. For example, because of printhead subunit thickness variation from wafer to wafer (normally $\pm 13$ micrometers), sideshooter printhead subunits for a given print bar may need to be taken from the same wafer to ensure thickness uniformity, while roofshooter die subunits can be taken from any wafer because the thickness variation occurs in the non-critical Z axis. Secondly, aligning printhead subunits in their natural plane, that is the plane of the wafer, as is done for roofshooter printheads, is already commercially done for a number full width arrays of silicon transducer technologies, therefor off-the-shelf commercial equipment exists for such alignment.

Figure 7:
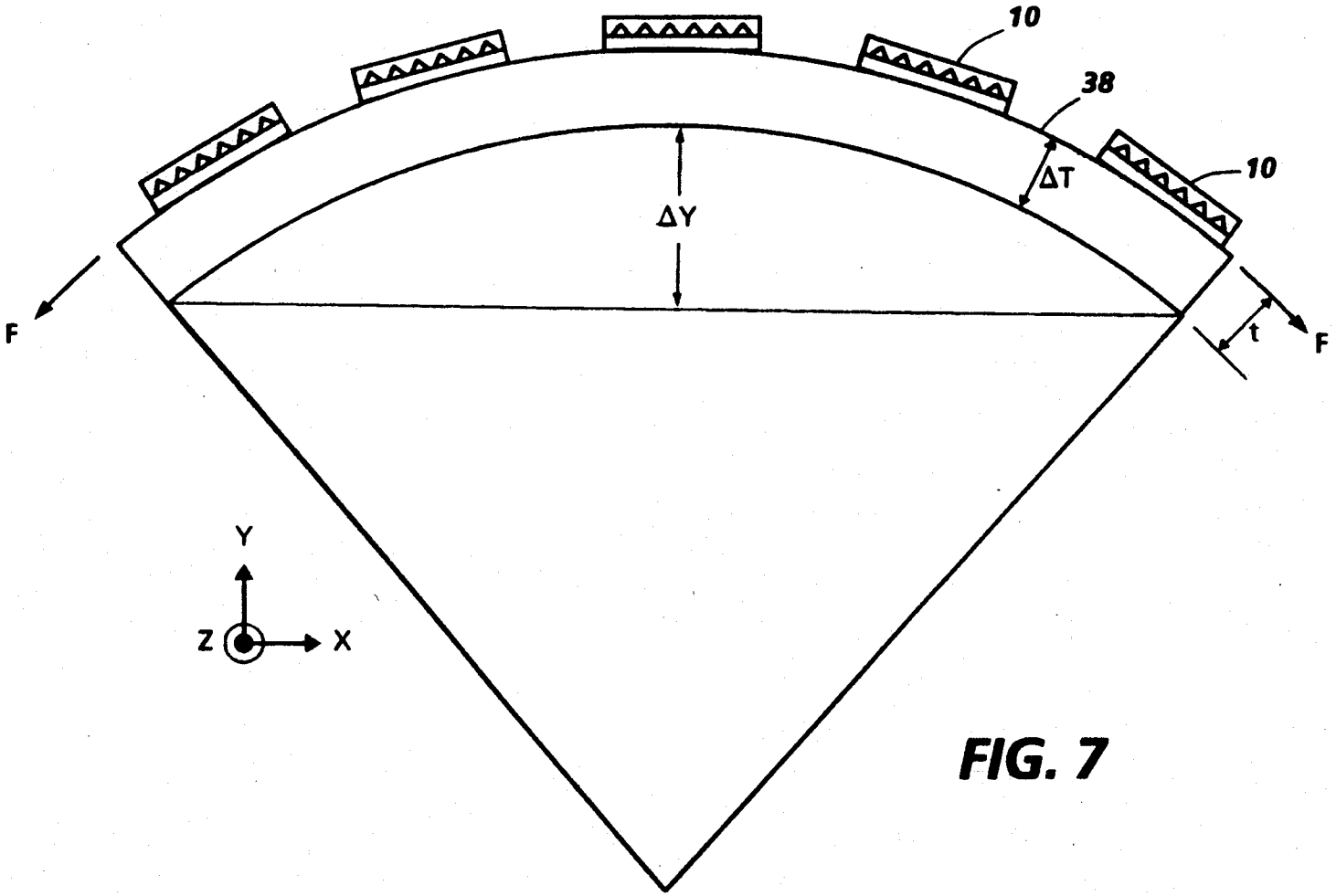
FIG. 7 schematically shows the warpage of the structural bar used in FIG. 3A.

Another advantage of the pagewidth thermal ink jet roofshooter print bar architecture lies in its stability to thermal excursions. FIG. 7 shows the problem for a pagewidth sideshooter architecture. Because the side of the bar with the bonded printheads will be at a higher temperature than the opposite side, thermal expansion of the warmer side will cause a bow in the bar. FIG. 7 gives a mechanical analysis of this situation. Assuming representative material constraints and dimensions, there is a bow in an eleven inch print bar corresponding to twelve micrometers for each degree centigrade gradient from the top to the bottom of the structural bar, even for an extremely low expansion material such as graphite. Furthermore, this bow affects spot placement in the critical Y direction for a sideshooter. As can be seen from FIG. 7, the critical dimension is the bar thickness t, which has a cubed relationship relative to the print bar stiffness (that is, warp resistance). Force $F=\alpha\Delta T\ AE$ where $\alpha$=the constant of thermal expansion, A=cross-sectional area, $\Delta T$=the thermal gradient, E=the modulus of elasticity, t=the bar thickness. Bending moment $M=Ft/2$, and radius of curvature $R=EI/M$, where I is the moment of inertia which equals thickness of the structural bar $t\times$the height cubed$\div 12$. If, for example, the structural bar is graphite for a $\Delta T=1°$ C., thickness=0.25 inches and the depth=2 inches, the constant of thermal expansion for graphite is equal to 2.5 cm/cm/°C. The modulus of elasticity for graphite is equal to $1.5\times 10^6$ psi. The force equals 2.5 pounds, the radius of curvature=24,000 inches and this results in a bow or change in the Y direction of 12 micrometers per degree centigrade.

For the pagewidth printhead using roofshooter printhead subunits shown in FIG. 6, it can be seen that the direction of thermally induced structural bar warp would be in the less critical Z axis direction and that the critical dimension T can be made very large. As an example of typical values, T might be 0.25 inches for a sideshooter and might be 2.5 inches for a roofshooter print bar. One reason the T dimension can be large for the roofshooter print bar is because it does not consume paper path space. The effect on the mechanical stability of the print bars would seem to be 1,000 times more rigid than the sideshooter print bar. In terms of ink distribution systems, the pagewidth roofshooter print bar does not require a dedicated ink manifold, since it can feed ink from a reservoir internal of the print bar substrate up through the slot in the silicon heater plate. This not only saves the cost of a manifold and the critical step of printhead to manifold ink sealing, but also allows the printhead and print bar substrate to transfer their heat to the ink which then gets expelled during printing. Thus, the pagewidth roofshooter print bar would have an advantage with respect to thermal management. Also, a pagewidth thermal ink jet print bar using roofshooter style printhead subunits enables the use of a print bar substrate having dimensions to minimize the Y axis dimensional tolerances and to provide a larger dimension in the Z axis which confers stiffness and a warp resistance to the print bar. A print bar substrate for a roofshooter pagewidth printhead may incorporate the ink distribution system internally, thus eliminating additional ink distribution components. In addition, this design is thermally advantaged in that the heat from the silicon subunits is transferred to the structural substrate and the ink, where it can more readily leave the ink printing system.

Figure 8:
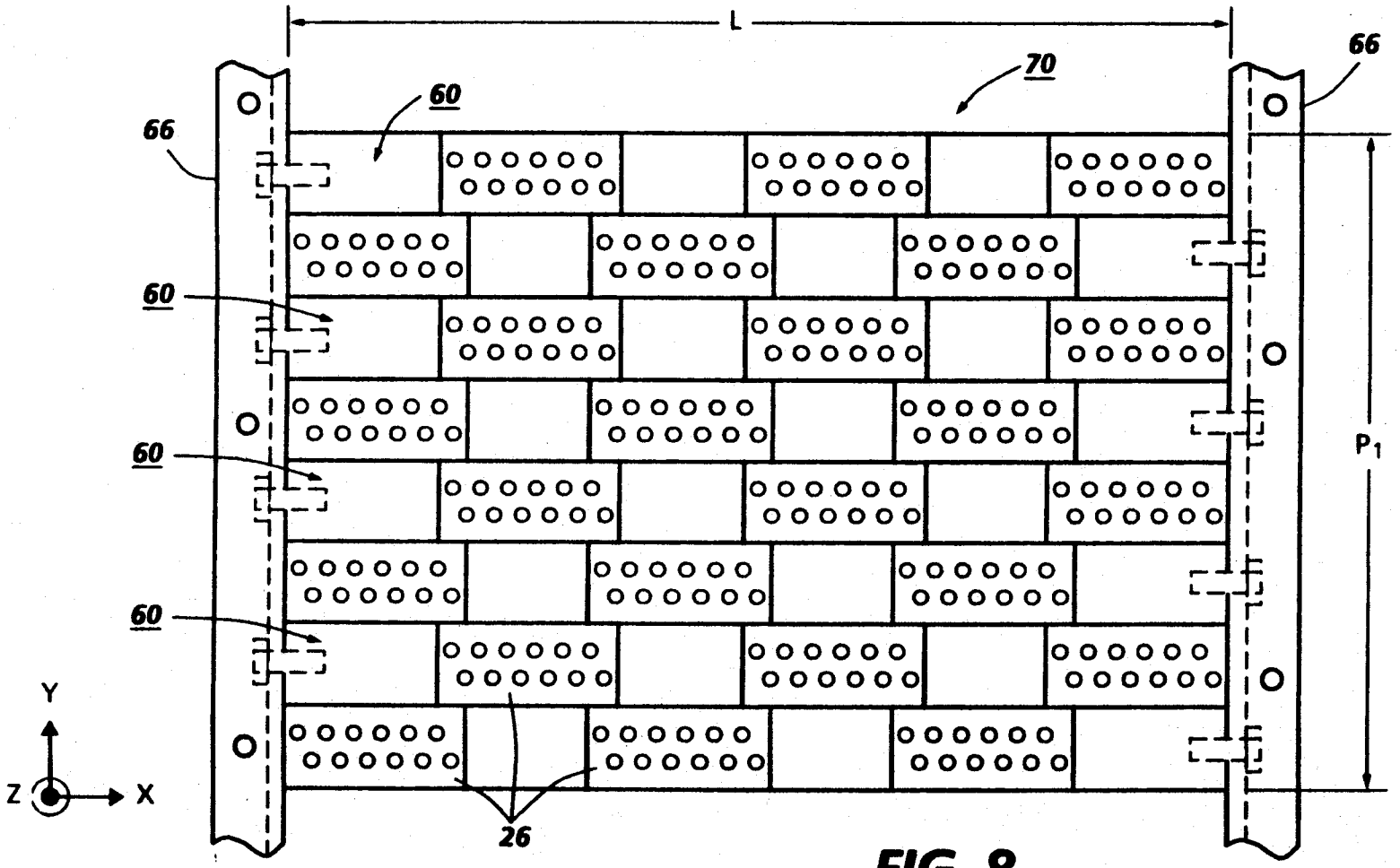
FIG. 8 is a front view of a multi-color pagewidth thermal ink jet printhead constructed from a plurality of the printheads shown in FIG. 6.
Figure 9:
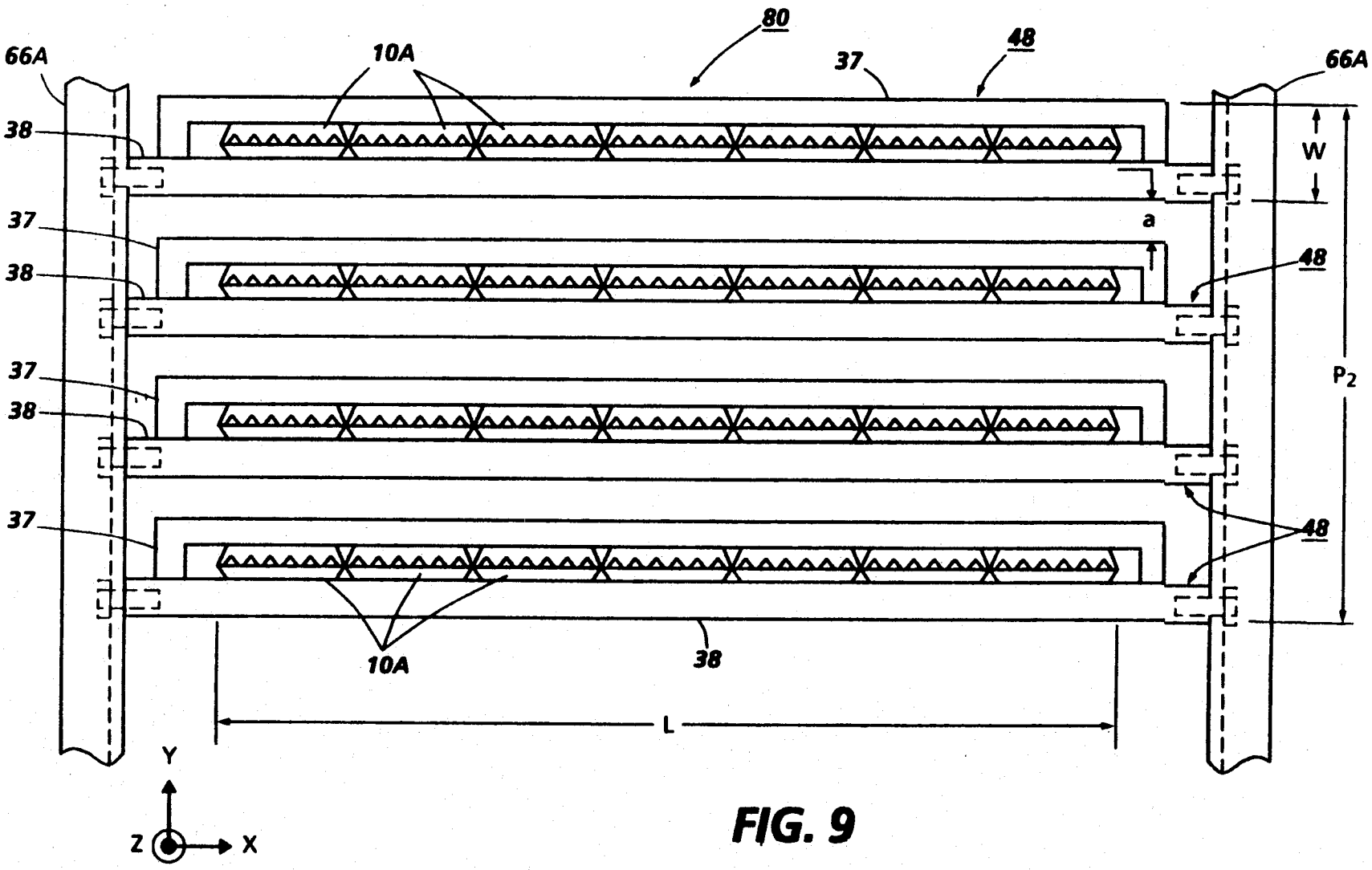
FIG. 9 is a front view of a multi-color pagewidth printhead formed from a plurality of pagewidth printheads shown in FIG. 5.

In multi-color ink jet printing systems, several pagewidth printheads must be used, one for each color. Generally, four printheads are used, one for black and one each for magenta, yellow and cyan. To prevent the ink from wicking into the recording medium, usually paper, it is important to minimize the area of the printing zone so that the ink can quickly be dried. A front view of a multi-colored thermal ink jet printhead is shown in FIG. 8 utilizing the roofshooter-type pagewidth printheads of the present invention and shown in FIG. 6. Because the printhead subunits are bonded to the edge of the structural bar facing the Z direction, the pagewidth printheads may be stacked one on top of the other spaced only by the flexible electrodes, which have a thickness of about 0.1 to 0.2 cm, thus presenting a printing area defined by the length of the pagewidth printhead and the distance defined by the thickness of four structural bars shown in FIG. 8 as L and $P_1$, respectively. In the preferred embodiment, L is between 8.5 inches (21.6 cm) and 11 inches (28 cm) and W (FIG. 6) is between 0.25 inches (0.64 cm) and 0.5 inches (1.3 cm), so that $P_1$ is between about 1.5 inches (3.8 cm) to 2.25 inches (5.7 cm). A similar front view of a multicolor pagewidth printer using sideshooter printhead subunits is shown in FIG. 9. Each of the pagewidth printheads uses the end-to-end abutment of printhead subunits, as shown in FIG. 5. The printing area is defined by the length L of the printing region of the pagewidth printheads and the height of four printheads with ink supplying manifolds 37 for each of the printheads so that the distance $P_2$ of the stacked pagewidth printheads is about 3 inches (7.6 cm) to 4 inches (10 cm) which is greater than that of the roofshooter type print bar. Any Y distance for a printing zone greater than 2.5 inches for the printing zone is considered detrimental for it permits the the wet ink too much time to wick into the paper before a means for drying can be applied, thereby allowing the paper to cockle or wrinkle. Though a sideshooter type pagewidth printhead using abutted subunits as shown in FIG. 5 was used in FIG. 9, substantially the same or large printing zone would be required for a multicolor ink jet printer using a plurality of pagewidth printheads depicted in FIGS. 3A and 3B. Therefore, the same unsatisfactory color printing would be achieved as with the printhead configuration shown in FIG. 9.

Many modifications and variations are apparent from the foregoing description of the invention and all such modifications and variations are intended to be within the scope of the present claims.

I claim:

1. A pagewidth, thermal ink jet printhead for use in an ink jet printer and of type assembled from a plurality of fully functional printhead subunits, each subunit having an array of droplet emitting nozzles, so that when the printhead is fixedly mounted in the printer, the nozzles confront a path through which a recording medium is moved to define a printing zone having the length of at least the width of a page, the printhead comprising:

a structural bar having an edge surface between end surfaces for mounting of roofshooter type printhead subunits thereon, the edge surface having a length at least equal to that of the printing zone, a predetermined width as measured in the direction perpendicular to the bar length and parallel to said bar edge surface, and a predetermined thickness as measured in a direction perpendicular to the bar edge surface, so that the edge surface of the bar has a surface area defined by the bar length and predetermined width, the predetermined width being a distance equal to a dimension of between one and two roofshooter type printhead subunits mounted on said bar edge surface, the predetermined bar thickness having a larger dimension than the bar width, the edge surface confronting the recording medium path when said structural bar is mounted in the printer;

a passageway being provided within the bar and being adjacently spaced a predetermined distance from the bar edge surface;

a plurality of openings penetrating the adjacent edge surface and communicating with the passageway;

a plurality of roofshooter type printhead subunits being mounted on the bar edge surface, each subunit having an ink inlet aligned with a respective one of the openings in said bar edge surface and having a plurality of heating elements, each of which is aligned with a respective one of the subunit nozzles for ejection of ink droplets in a direction normal to the heating elements and towards the recording medium path;

means for fixedly mounting the structural bar within the printer, so that the subunits confront the recording medium and are spaced predetermined distance therefrom;

means for providing ink to the bar passageway from an ink supply; and means for selectively applying electrical signals to the heating elements of the subunits, the signals representing digitized data for the drop-on-demand ejection of ink droplets by the temporary vaporization of ink as a result of the application of the electrical signals, whereby the structural bar thickness is sufficient to provide enough mass for the bar to prevent its warping as a result of the operating temperature of the pagewidth printhead.

2. The pagewidth printhead of claim 1, wherein a multicolor printer is produced by stacking a plurality of said pagewidth printheads with their respective subunits confronting the printing zone of the printer and supplying a different colored ink to each pagewidth printhead from separate ink supplies, whereby the multicolor printer has a minimized multicolor printing zone.

3. The pagewidth printhead of claim 1, wherein the roofshooter printhead subunits are mounted on the edge surface of the bar in two rows in a staggered arrangement.

4. The pagewidth printhead of claim 3, wherein each printhead subunit has two rows of nozzles.

5. The pagewidth printhead of claim 1, wherein the roofshooter printhead subunits are mounted on the edge surface of the bar in a single, abutted collinear row of subunits.

6. The pagewidth printhead of claim 1, wherein the structural bar comprises two parts, a main part with a groove in the edge surface thereof and the other part being a cover mounted on the edge surface of said main part and over the groove therein to form the passageway in said bar, the plurality of openings being in said cover, so that said edge surface of the bar whereon the subunits are mounted is the outer surface of the cover.

7. A pagewidth thermal ink jet printhead assembled from a plurality of fully functional roofshooter type printhead subunits, comprising:

a structural bar having a planar edge surface confronting and parallel to a path through which a recording medium having a predetermined width is moved, the edge surface having a length at least equal to the width of the recording medium and a width equal to the distance of one to two roofshooter type printhead subunits to be mounted along the length of the bar edge surface, the thickness of the structural bar being greater than the width of the bar edge surface; and a plurality of roofshooter type printhead subunits being linearly mounted on the bar edge surface, each printhead subunit having ink droplet ejecting nozzles which eject droplets in a direction perpendicular to the bar edge surface toward the recording medium as said recording medium moves past the pagewidth printhead, so that the structural bar has sufficient stiffness in the direction perpendicular to the bar edge surface to provide warp resistance to printhead operating temperatures.

8. The printhead of claim 7, wherein the structural bar has a uniform cross-sectional area, and wherein the printhead subunits are mounted within the periphery of the bar edge surface, so that multiple pagewidth printheads, each with a different color ink, may be stacked to form a multicolor printhead assembly thereby providing a minimized dimension in the direction of movement of the recording medium therepast.

* * * * *